US008348278B2

(12) United States Patent
Tseng

(10) Patent No.: US 8,348,278 B2
(45) Date of Patent: Jan. 8, 2013

(54) PLAYING CARD DISPENSING AND OPENING SYSTEM

(76) Inventor: Tzu-Hsiang Tseng, Taichung (TW)

( * ) Notice: Subject to any disclaimer, the term of this patent is extended or adjusted under 35 U.S.C. 154(b) by 83 days.

(21) Appl. No.: 12/983,422

(22) Filed: Jan. 3, 2011

(65) Prior Publication Data

US 2012/0169009 A1 Jul. 5, 2012

(51) Int. Cl.
*A63F 1/10* (2006.01)
*A63F 1/14* (2006.01)

(52) U.S. Cl. ..... 273/149 R; 273/148 A; 273/148 R

(58) Field of Classification Search ..... 273/149 R, 273/149 P, 148 R, 148 A
See application file for complete search history.

(56) References Cited

U.S. PATENT DOCUMENTS

| | | | | |
|---|---|---|---|---|
| 5,382,024 | A * | 1/1995 | Blaha | 273/149 R |
| 6,361,044 | B1 * | 3/2002 | Block et al. | 273/149 R |
| 6,938,896 | B2 * | 9/2005 | Tsuchida | 273/148 A |
| 7,392,936 | B1 * | 7/2008 | Green et al. | 235/379 |
| 7,775,522 | B2 * | 8/2010 | Tseng | 273/145 C |
| 2007/0090595 | A1 * | 4/2007 | Csikos | 273/149 R |
| 2008/0111300 | A1 * | 5/2008 | Czyzewski et al. | 273/149 R |
| 2009/0066021 | A1 * | 3/2009 | Shigeta | 273/149 R |

* cited by examiner

*Primary Examiner* — Benjamin Layno
(74) *Attorney, Agent, or Firm* — Rosenberg, Klein & Lee

(57) ABSTRACT

A playing card dispensing and opening system includes a motor drive unit controllable to rotate a first output shaft and rubber card-dispensing wheels in dispensing playing cards and to rotate a second output shaft and a crank arm in moving a transparent flat shovel for opening each dispensed playing card and then carrying the playing card to a playing card recycling chamber for recycling.

2 Claims, 3 Drawing Sheets

PLAYING CARD DISPENSING AND OPENING SYSTEM

BACKGROUND OF THE INVENTION

1. Field of the Invention

The present invention relates to playing card dispensers and more particularly, to a playing card dispensing and opening system that automatically dispenses playing cards and opens and recycles each dispensed playing card.

2. Description of the Related Art

Conventional playing card dispensers include two types. A first type of playing card dispenser is known comprising a chute having a chute for holding a deck of playing cards, and a motor drive controllable to rotate a card-dispensing roller in dispensing playing cards out of the chute. This design of playing card dispenser simply dispenses playing cards. The dealer needs to open each dispensed playing card, or a complicated and expensive mechanical arm shall be used to open each dispensed playing card. A second type of playing card dispenser is known comprising a shoe for holding a deck of playing cards and a mechanical arm for picking up playing cards from the shoe and opening each playing card immediately after removal from the shoe. A playing card of the second type is expensive and does not simulate dealing of cards by a dealer.

SUMMARY OF THE INVENTION

The present invention has been accomplished under the circumstances in view. It is one object of the present invention to provide a playing card dispensing and opening system, which automatically dispenses playing cards and automatically opens and recycles each dispensed playing card, simulating dealing of playing cards by a human being and avoiding direct contact of the playing cards by the dealer to prevent cheating.

To achieve this and other objects of the present invention, a playing card dispensing and opening system comprises a housing holding a deck of playing cards, a scanner and a plurality of infrared sensors arranged in front of the housing and adapted for scanning each dispensed playing card, a motor drive unit, a first output shaft mounted with rubber card-dispensing wheels and rotatable by the motor drive unit to dispense the playing cards, a second output shaft rotatable by the motor drive unit, a transparent flat shovel, a crank arm connected between the second output shaft and the transparent flat shovel for moving the transparent flat shovel to open each dispensed playing card and then to carry the playing card to a playing card recycling chamber for recycling.

DETAILED DESCRIPTION OF THE PREFERRED EMBODIMENT

Figure 1:
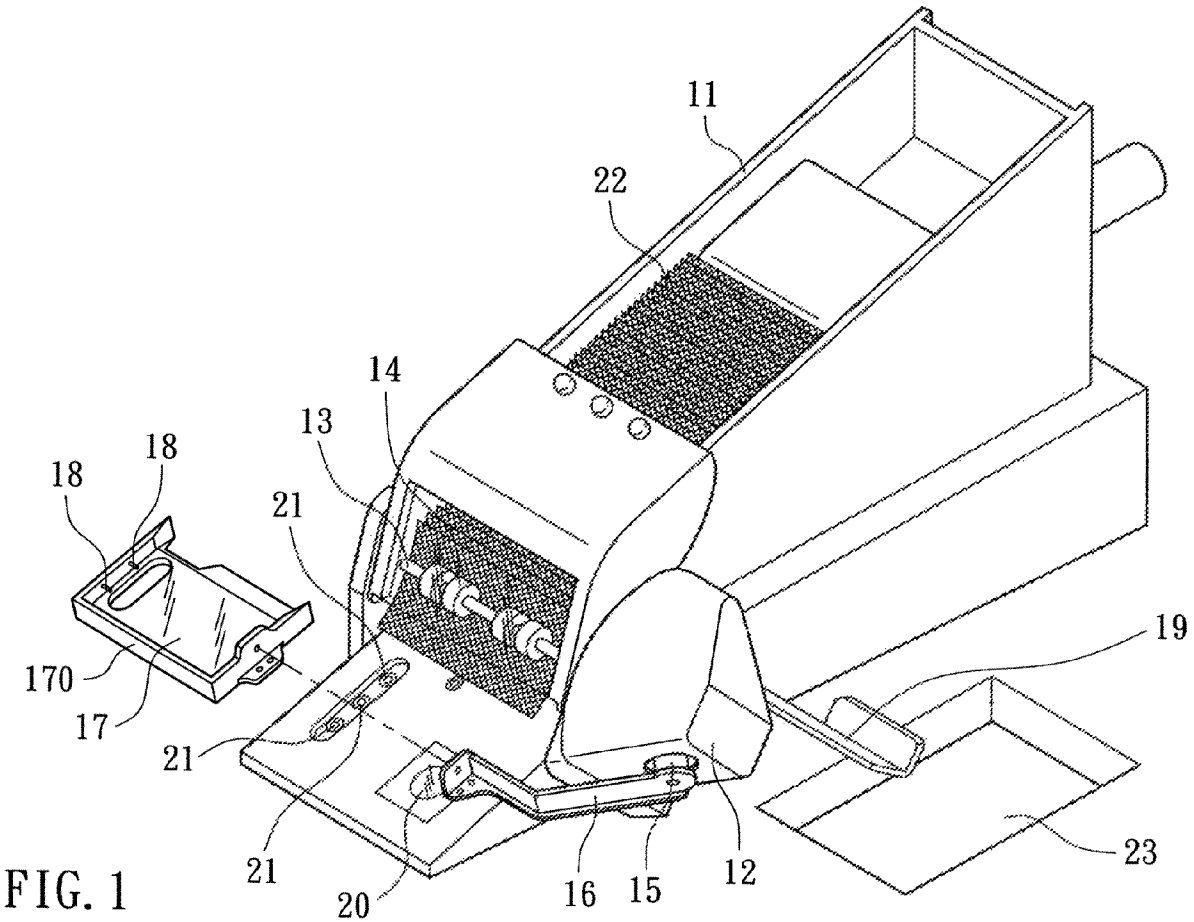
FIG. 1 is an exploded view of a playing card dispensing and opening system according to the present invention.

Referring to FIGS. 1~4, a playing card dispensing and opening system in accordance with the present invention is shown comprising a housing 11 holding a deck of playing cards 22, a scanner 20 and infrared sensors 21 arranged in front of the housing 11, a motor drive unit 12 provided at one lateral side of the housing 11, a first output shaft 13 extending out of the motor drive unit 12 and transversely pivotally supported in the front side of the housing 11, a second output shaft 15 extending out of the motor drive unit 12 and suspending outside the housing 11, rubber card-dispensing wheels 14 mounted on the first output shaft 13 and rotatable with the first output shaft 13 to dispense the playing cards 22, a crank arm 16 connected to the distal end of the second output shaft 15 outside the motor drive unit 12, a transparent flat shovel 17 fastened to one end of the crank arm 16 opposite to the second output shaft 15, a baffle 19 fixedly disposed at one side of the motor drive unit 12 and adapted for stopping the crank arm 16 to limit its angle of rotation, and a playing card recycling chamber 23 arranged below the baffle 19. Further, the transparent flat shovel 17 has an upright peripheral wall 170 extending along three of the four sides thereof and a plurality of stop pins 18 perpendicularly extended from the upright peripheral wall 170 and suspending above the bottom wall of the transparent flat shovel 17 at a predetermined elevation for stopping one playing card 22 in the transparent flat shovel 17.

The operation of the playing card dispensing and opening system will now be described hereinafter.

Figure 2:
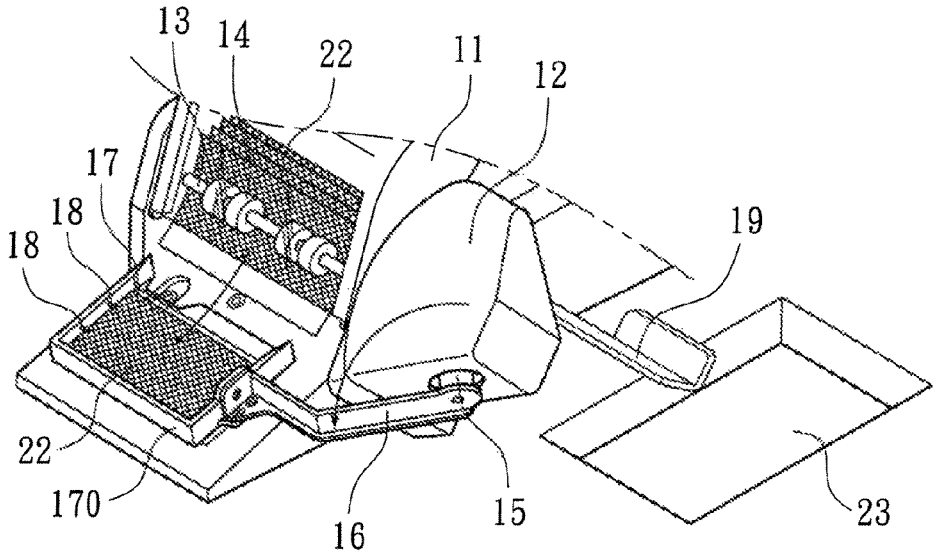
FIG. 2 is a schematic drawing of the present invention, illustrating a card-dispensing operation of the playing card dispensing and opening system.

1. Card-Dispensing and Face-Down:

As shown in FIG. 2, the transparent flat shovel 17 is aimed at the front opening of the housing 11, and the motor drive unit 12 is controlled to rotate the first output shaft 13 and the rubber card-dispensing wheels 14 in moving one playing card 22 out of the housing 11 into the transparent flat shovel 17. At the same time, the scanner 20 and the infrared sensors 21 are controlled to scan the dispensed playing card 22 for counting. At this time, the displayed playing card 22 is kept face-down.

Figure 3:
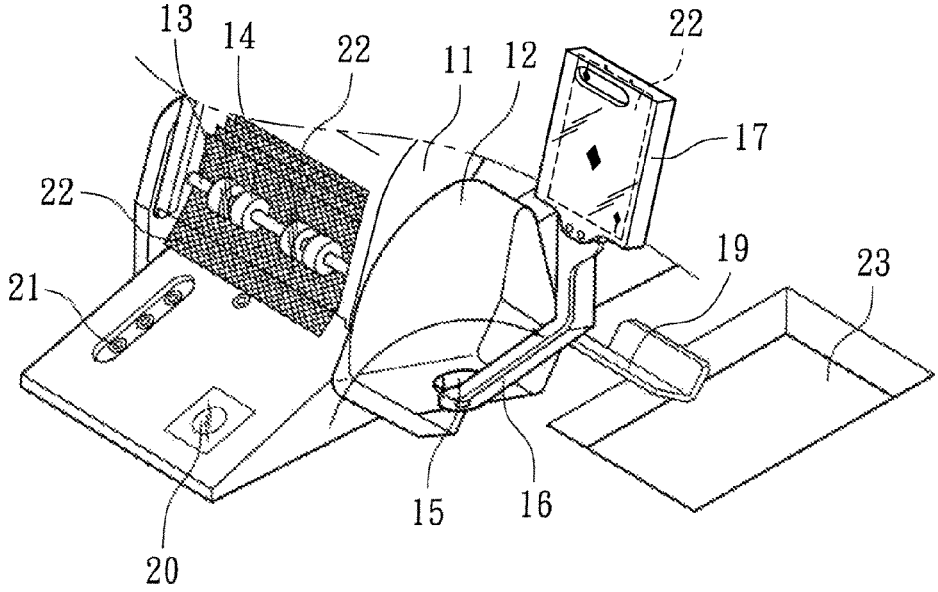
FIG. 3 is a schematic drawing of the present invention, illustrating a card-opening operation of the playing card dispensing and opening system.

2. Card Face-Up:

As shown in FIG. 3, the motor drive unit 12 is controlled to rotate the second output shaft 15 and the crank arm 16 through a predetermined angle, holding the transparent flat shovel 17 in vertical to show the face of the dispensed playing card 22. Subject to the constraint of the stop pins 18, the dispensed playing card 22 is held in the transparent flat shovel 17 positively in position.

Figure 4:
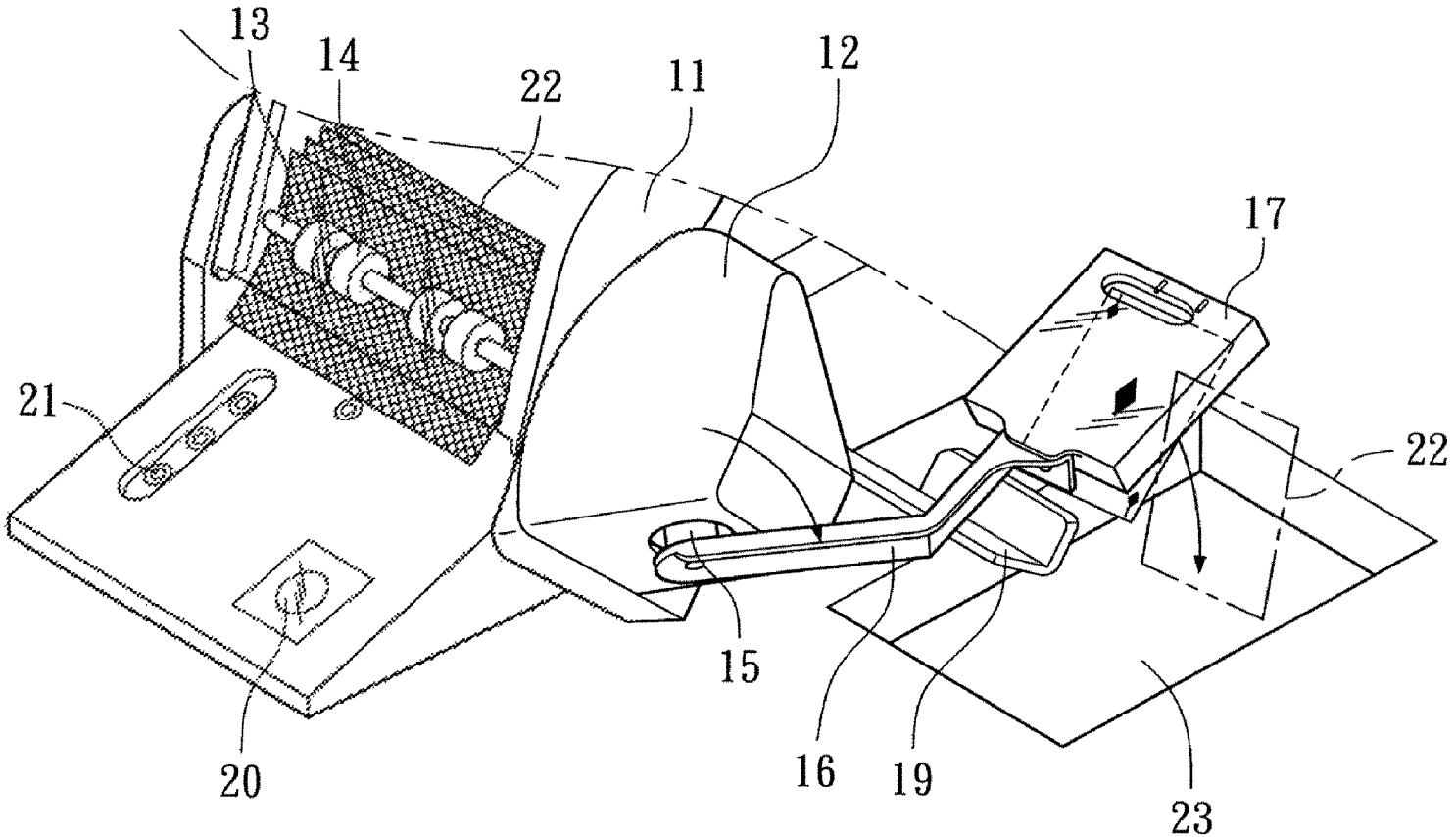
FIG. 4 is a schematic drawing of the present invention, illustrating a card-recycling operation of the playing card dispensing and opening system.

3. Card-Recycling:

As shown in FIG. 4, the motor drive unit 12 is controlled to rotate the second output shaft 15 and the crank arm 16 through a further predetermined angle to tilt the transparent flat shovel 17 downwards, enabling the dispensed playing card 22 to fall out of the transparent flat shovel 17 into the playing card recycling chamber 23.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A playing card dispensing and displaying system, comprising:

a housing holding a deck of playing cards;

a scanner and a plurality of infrared sensors arranged in front of said housing and adapted for scanning each dispensed playing card;

a motor drive unit disposed at one lateral side of said housing;

a first output shaft transversely pivotally supported in a front side of said housing and rotatable by said motor drive unit;

a plurality of rubber card-dispensing wheels mounted on said first output shaft and rotatable with said first output shaft to dispense said playing cards out of said housing;

a second output shaft suspending outside said housing and rotatable by said motor drive unit;

a crank arm connected to a distal end of said second output shaft outside said motor drive unit;

a transparent flat shovel fastened to one end of said crank arm opposite to said second output shaft positioned adjacent to said housing to catch each dispensed said playing card, said motor drive unit rotates said second output shaft, said output shaft pivots said crank arm and fastened said transparent flat shovel to display said playing card;

a baffle fixedly disposed at one side of said motor drive unit and adapted for stopping said crank arm to limit the angle of rotation of said crank arm; and a playing card recycling chamber arranged below said baffle for collecting said playing cards.

2. The playing card dispensing and displaying system as claimed in claim 1, wherein said transparent flat shovel comprises a rectangular bottom wall and an upright peripheral wall extending along three of four sides of said rectangular bottom wall and a plurality of stop pins perpendicularly extended from said upright peripheral wall and suspending above said rectangular bottom wall at a predetermined elevation to catch said dispensed playing card and temporarily hold said playing card while being displayed.

* * * * *